US009383705B2

(12) United States Patent
Hirai et al.

(10) Patent No.: US 9,383,705 B2
(45) Date of Patent: Jul. 5, 2016

(54) WET-TYPE IMAGE FORMATION APPARATUS ADJUSTING TONER CONVEYANCE AMOUNT AND TONER CHARGE AMOUNT

(71) Applicant: Konica Minolta, Inc., Chiyoda-ku (JP)

(72) Inventors: Atsuto Hirai, Ikoma (JP); Takeshi Maeyama, Ikeda (JP); Yuuya Sato, Settsu (JP); Makiko Watanabe, Uji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/483,729

(22) Filed: Sep. 11, 2014

(65) Prior Publication Data

US 2015/0071664 A1 Mar. 12, 2015

(30) Foreign Application Priority Data

Sep. 12, 2013 (JP) ..... 2013-189591

(51) Int. Cl.
*G03G 15/08* (2006.01)
*G03G 15/00* (2006.01)
*G03G 15/10* (2006.01)

(52) U.S. Cl.
CPC ..... *G03G 15/5058* (2013.01); *G03G 15/10* (2013.01)

(58) Field of Classification Search
CPC . G03G 15/105; G03G 15/02; G03G 15/5041; G03G 2215/0629; G03G 2215/00037
USPC ..... 399/53, 72
See application file for complete search history.

(56) References Cited

U.S. PATENT DOCUMENTS

2004/0114964 A1* 6/2004 Kitazawa ..... G03G 15/10 399/237

(Continued)

FOREIGN PATENT DOCUMENTS

JP 60-217376 A 10/1985
JP 2004-117846 A 4/2004

(Continued)

OTHER PUBLICATIONS

Notice of Grounds of Rejection dated Aug. 18, 2015 issued in the Japanese Patent Office in the corresponding Japanese Patent Application No. 2013-189591 and English translation (10 pages).

*Primary Examiner* — Billy Lactaoen
(74) *Attorney, Agent, or Firm* — Buchanan Ingersoll & Rooney PC

(57) ABSTRACT

In the present wet-type image formation apparatus, when setting a standard image formation condition, a control unit adjusts both a conveyance amount of toner and a charge amount of the toner in order to obtain a predetermined developing characteristic. During normal image formation, the control unit obtains the image density of a patch image formed at a high contrast potential and the image density of a patch image formed at a low contrast potential, adjusts the conveyance amount of the toner when the image density of the patch image formed at the high contrast potential is varied from the developing characteristic for the standard image formation condition, and adjusts the charge amount of the toner when the image density of the patch image formed at the low contrast potential is varied from the developing characteristic for the standard image formation condition.

7 Claims, 9 Drawing Sheets

(56) References Cited

U.S. PATENT DOCUMENTS

| | | | | |
|---|---|---|---|---|
| 2008/0273889 | A1 | 11/2008 | Kitazawa et al. | |
| 2009/0110422 | A1* | 4/2009 | Shinichi | G03G 15/065 399/55 |
| 2010/0266296 | A1* | 10/2010 | Ochiai | G03G 15/5033 399/27 |
| 2011/0206397 | A1 | 8/2011 | Higuchi et al. | |
| 2013/0101304 | A1* | 4/2013 | Sasaki | G03G 15/10 399/49 |
| 2013/0148992 | A1* | 6/2013 | Oshima | G03G 15/0877 399/53 |

FOREIGN PATENT DOCUMENTS

| | | | |
|---|---|---|---|
| JP | 2004-117847 | A | 4/2004 |
| JP | 2008-170602 | A | 7/2008 |
| JP | 2009-015351 | A | 1/2009 |
| JP | 2010-061079 | A | 3/2010 |
| JP | 2010-204467 | A | 9/2010 |
| JP | 2010-230787 | A | 10/2010 |
| JP | 2011-175052 | A | 9/2011 |
| JP | 2012-063411 | A | 3/2012 |
| JP | 2013-092602 | A | 5/2013 |

* cited by examiner

WET-TYPE IMAGE FORMATION APPARATUS ADJUSTING TONER CONVEYANCE AMOUNT AND TONER CHARGE AMOUNT

This application is based on Japanese Patent Application No. 2013-189591 filed with the Japan Patent Office on Sep. 12, 2013, the entire content of which is hereby incorporated by reference.

BACKGROUND OF THE INVENTION

1. Field of the Invention

The present invention relates to a wet-type image formation apparatus, in particular, a wet-type image formation apparatus that controls an image formation condition based on image density of a patch image.

2. Description of the Related Art

A wet-type image formation apparatus includes a photoconductor, a developing roller, and the like. An amount of toner supplied from the developing roller onto the photoconductor to develop an electrostatic latent image is dependent on an amount of toner on the developing roller (amount of toner conveyed to a developing portion). Each of characteristics of the photoconductor and the developing roller is likely to be varied by being affected by a change in environment around the apparatus, a period of use of the apparatus, or the like. The variation in each characteristic leads to variation in the amount of the toner supplied to the electrostatic latent image, thereby affecting the density of an image finally formed on a recording medium.

In order to attain a desired value for the density of an image formed on a recording medium irrespective of the variation in each characteristic of the photoconductor and the developing roller, the amount of the toner on the developing roller (amount of liquid developer) is controlled, for example. By controlling the amount of the toner on the developing roller (the amount of the toner conveyed to the developing portion), a developing characteristic is changed, whereby an image having a desired image density can be formed on a recording medium.

In order to form such an image having a desired image density on a recording medium, a predetermined developing characteristic is also required. In the predetermined developing characteristic, developing efficiency is saturated when a contrast potential (also referred to as "developing contrast potential") is set at a certain value or more, whereby the amount of the toner supplied onto the photoconductor becomes constant. Image formation is performed under a condition that such a developing characteristic is obtained. In order to obtain such a developing characteristic, it is necessary to control the amount of the toner on the developing roller (the amount of the toner conveyed to the developing portion), for example.

It is also necessary to control an charge amount of the toner in the liquid developer conveyed to the developing portion in order to obtain the above-described developing characteristic. The charge amount of the toner has influences over not only the developing characteristic (developing efficiency) but also dot reproducibility and image uniformity, so that the charge amount of the toner is preferably higher. However, if the charge amount of the toner is higher than necessary, the contrast potential for saturating the developing efficiency becomes also higher, so that the charge amount of the toner needs to be set at an appropriate value.

As described above, in the wet-type image formation apparatus, in order to stably form a high-quality image, it is general to control both the amount of the liquid developer on the developing roller and the charge amount of the toner conveyed to the developing portion (see Japanese Laid-Open Patent Publication No. 2010-204467, Japanese Laid-Open Patent Publication No. 2008-170602, Japanese Laid-Open Patent Publication No. 2011-175052, Japanese Laid-Open Patent Publication No. 2012-063411, Japanese Laid-Open Patent Publication No. 2009-015351, Japanese Laid-Open Patent Publication No. 2004-117847, and Japanese Laid-Open Patent Publication No. 2004-117846). The control for them is performed immediately after starting the apparatus, or the like. The density of a patch image is detected, and then based on the detection result, the amount of the liquid developer on the developing roller and the charge amount of the toner conveyed to the developing portion are adjusted.

Generally, the amount of the liquid developer on the developing roller is adjusted, and thereafter the charge amount of the toner conveyed to the developing portion is adjusted. Specifically, first, by setting the charge amount of the toner at a low value and setting the contrast potential at a high value, the developing characteristic for saturating the developing efficiency is attained. The amount of the liquid developer on the developing roller is adjusted such that the image density of a patch image upon saturation falls within a target range. After adjusting the amount of the liquid developer on the developing roller, the charge amount of the toner is adjusted to a value near the upper limit with which the predetermined developing efficiency can be maintained with a standard contrast potential. In this way, the amount of the liquid developer on the developing roller and the charge amount of the toner are adjusted to appropriate values, thereby obtaining an ideal developing characteristic (standard condition) with which a desired image density can be obtained.

SUMMARY OF THE INVENTION

In the case where the charge amount of the toner conveyed to the developing portion is adjusted after adjusting the amount of the liquid developer on the developing roller, it is difficult to shorten a time necessary for the adjustments. It is difficult to perform such adjustments in parallel with image outputting. For the adjustments, the image outputting operation needs to be suspended whenever a certain time has passed during the image outputting, which results in decrease in productivity. Moreover, the liquid developer is also necessary for the adjustment of density, which results in increase in an amount of consumption of the liquid developer.

In order to reduce the decrease in productivity, it is considered to perform the adjustments less frequently, but in this case, the image density of the output image is not adjusted for a long time. This provides a concern such that density variation may take place while no adjustment is performed and a desired image density cannot be obtained accordingly. In particular, the wet-type image formation apparatus, which forms images at a high speed, outputs a large number of recording mediums per unit time and is required to achieve high productivity, so that it is not preferable to perform the adjustments less frequently.

The present invention has been made in view of the current circumstance described above, and has an object to provide a wet-type image formation apparatus capable of adjusting an image formation condition in a short time.

A wet-type image formation apparatus based on an aspect of the present invention includes: an image carrier carrying an electrostatic latent image; a developer carrier conveying liquid developer to a developing portion, which is a position opposite to the image carrier, and developing the electrostatic latent image to form a toner image; a detecting unit detecting an image density of the toner image; and a control unit adjusting, based on the image density detected by the detecting unit, conveyance amount and charge amount of toner in the liquid developer conveyed to the developing portion by the developer carrier, when setting a standard image formation condition for performing normal image formation, the control unit adjusting both the conveyance amount and the charge amount such that an image density of the toner image becomes constant even when a contrast potential is increased to be equal to or more than a predetermined standard contrast potential and such that a developing characteristic is obtained in which the image density of the toner image having become constant falls in a target density range, and setting a condition attained at a time of completion of the adjustments as the standard image formation condition, during the normal image formation, the control unit obtaining an image density of a patch image formed at a high contrast potential higher than the standard contrast potential and an image density of a patch image formed at a low contrast potential lower than the standard contrast potential, the control unit adjusting the conveyance amount when the image density of the patch image formed at the high contrast potential is varied from the developing characteristic for the standard image formation condition, the control unit adjusting the charge amount when the image density of the patch image formed at the low contrast potential is varied from the developing characteristic for the standard image formation condition.

Preferably, during the normal image formation, the contrast potential is set at each of the standard contrast potential, the high contrast potential, and the low contrast potential, the detecting unit detects the image density of the patch image formed at the standard contrast potential, the image density of the patch image formed at the high contrast potential, and the image density of the patch image formed at the low contrast potential, and the control unit adjusts the conveyance amount or the charge amount based on three detection results for the image densities detected by the detecting unit.

Preferably, during the normal image formation, the contrast potential is set at each of the high contrast potential and the low contrast potential, the detecting unit detects the image density of the patch image formed at the high contrast potential and the image density of the patch image formed at the low contrast potential, and the control unit adjusts the conveyance amount or the charge amount based on two detection results for the image densities detected by the detecting unit and a correction table provided in advance.

Preferably, the control unit adjusts the conveyance amount by changing rotating speed of a feeding roller supplying the liquid developer to the developer carrier, and adjusts the charge amount by changing an output of a charging device charging the toner in the liquid developer conveyed to the developing portion by the developer carrier.

Preferably, when setting the standard image formation condition for performing the normal image formation, the control unit sets the standard image formation condition and prepares the correction table.

A wet-type image formation apparatus based on another aspect of the present invention includes: a developer carrier for forming a toner image on an image carrier; a feeding device supplying liquid developer onto the developer carrier; a charging device charging toner in the liquid developer; a detecting unit detecting image densities of a plurality of patch images formed at different contrast potentials; and a control unit adjusting, based on the image densities of the plurality of patch images detected by the detecting unit, at least one of an amount of the liquid developer supplied to the developer carrier and a charge amount of the toner in the liquid developer.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
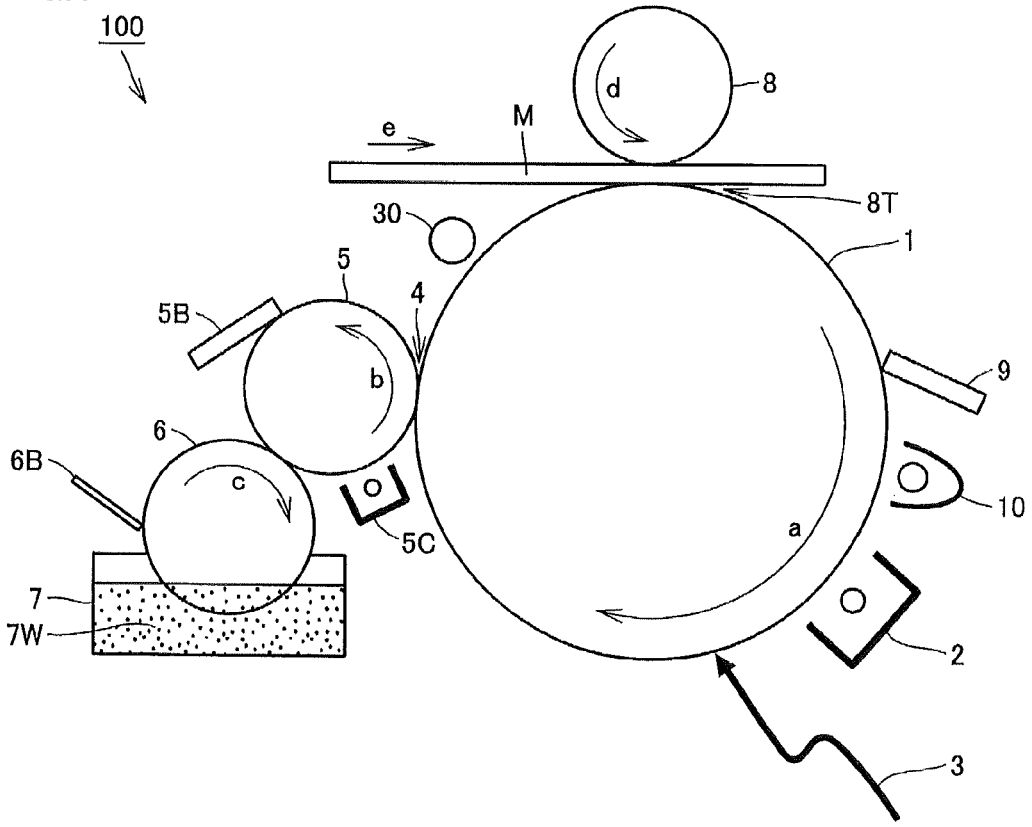
FIG. 1 shows a wet-type image formation apparatus in a first embodiment.

With reference to figures, the following describes each of embodiments based on the present invention. When mentioning the number, an amount, or the like in description for each of the embodiments, the scope of the present invention is not necessarily limited to the number, the amount, or the like, unless otherwise noted. In the description of each of the embodiments, the same or corresponding components are given the same reference characters and may not be described repeatedly.

[First Embodiment]

Wet-Type Image Formation Apparatus 100

Figure 2:
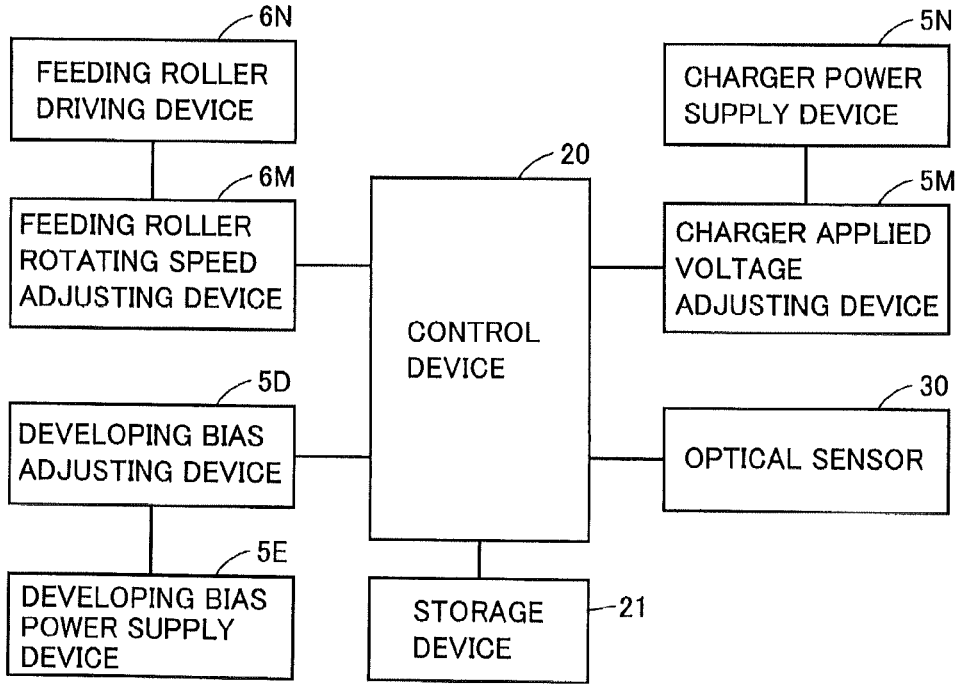
FIG. 2 is a block diagram showing each element of the wet-type image formation apparatus in the first embodiment.

With reference to FIG. 1 and FIG. 2, a wet-type image formation apparatus 100 in the present embodiment will be described. Wet-type image formation apparatus 100 includes a photoconductor 1 (image carrier), a charging device 2, an exposure device 3, a developing portion 4, a developing roller 5 (developer carrier), a cleaning blade 5B, a charger 5C (charging device), a feeding roller 6 (feeding device), a restriction blade 6B, a developer tank 7, liquid developer 7W, a transferring roller 8, a cleaning blade 9, an eraser lamp 10, a control device 20 (control unit) (see FIG. 2), an optical sensor 30 (detecting unit), and the like.

Photoconductor 1 is rotated in a direction of arrow a. Charging device 2, exposure device 3, developing roller 5, optical sensor 30, transferring roller 8, cleaning blade 9, and eraser lamp 10 are arranged in this order around photoconductor 1 in the rotation direction of photoconductor 1. Developing portion 4 is formed between photoconductor 1 and developing roller 5.

Charging device 2 uniformly charges the surface of photoconductor 1. Exposure device 3 emits light to the surface of photoconductor 1 based on image information. With the potential of the image portion being attenuated, an electrostatic latent image is formed on the surface of photoconductor 1. The portion having the electrostatic latent image formed thereon in the surface of photoconductor 1 is moved toward developing portion 4 according to the rotation of photoconductor 1.

Developer tank 7 has liquid developer 7W stored therein. As main components, liquid developer 7W includes: insulating liquid serving as carrier liquid; toner (toner particles) made of a coloring agent, a resin, and the like; and a dispersant for dispersing the toner in the carrier liquid. Feeding roller 6 is rotated in a direction of arrow c. For feeding roller 6, the following can be used: a roller made of urethane; a rubber roller made of NBR (Nitrile Butadiene Rubber); an anilox roller having a recess provided at its surface; or the like.

According to rotation of feeding roller 6, liquid developer 7W is drawn onto the surface of feeding roller 6. Liquid developer 7W is carried by feeding roller 6, and is then restricted to have a certain film thickness by scraping an excess amount thereof using restriction blade 6B. According to the rotation of feeding roller 6, liquid developer 7W is conveyed to a portion (rolling contact portion) at which feeding roller 6 and developing roller 5 face each other.

Developing roller 5 is rotated in a direction of arrow b. For developing roller 5, the following can be used: a roller made of urethane; or a rubber roller made of NBR. Developing roller 5 has a shape of roller, but a belt-shaped member may be used as the developer carrier. Feeding roller 6 and developing roller 5 are rotated such that the surfaces of the rollers are moved in the same direction at the rolling contact portion. When liquid developer 7W reaches the rolling contact portion (nip portion), liquid developer 7W is moved from feeding roller 6 onto developing roller 5. On developing roller 5, a thin layer of liquid developer 7W is formed which is adjusted to have a thickness uniform in the longitudinal direction.

The toner in the thin layer formed by liquid developer 7W passes, according to the rotation of developing roller 5, through a portion at which developing roller 5 and charger 5C face each other. The toner is charged by current flowing from charger 5C to developing roller 5. As the charging device, a charging roller or a charging electrode may be used instead of charger 5C. By using the electrode in contact with the liquid developer, applied voltage can be set to be low, which leads to low cost. According to the rotation of developing roller 5, liquid developer 7W is further conveyed toward a portion (developing portion 4) at which developing roller 5 and photoconductor 1 face each other.

Between developing roller 5 and photoconductor 1 (developing portion 4), a contrast potential (developing potential difference) is provided. Due to an effect of electric field formed in developing portion 4, the liquid developer (the carrier liquid and the toner) is electrostatically moved from developing roller 5 onto photoconductor 1. In a print portion in the electrostatic latent image on photoconductor 1, the toner is moved to the photoconductor 1 side. In a background portion in the electrostatic latent image on photoconductor 1, the toner is moved to the developing roller 5 side.

By visualizing the electrostatic latent image carried by photoconductor 1, a toner image (or a patch image described below) corresponding to the shape of the electrostatic latent image is formed on the surface of photoconductor 1. According to the rotation of photoconductor 1, the toner image is conveyed toward a portion (transferring portion 8T) at which photoconductor 1 and transferring roller 8 face each other.

Liquid developer having not been moved from developing roller 5 to photoconductor 1 and remaining on developing roller 5 is scraped off from the surface of developing roller 5 by cleaning blade 5B and is then collected. The collected liquid developer has a toner density different from that of liquid developer 7W in developer tank 7, is therefore sent to a tank (not shown) different from developer tank 7, is adjusted in toner density, and is then supplied to developer tank 7 again.

Transferring roller 8 is disposed to face photoconductor 1 and is rotated in a direction of arrow d. Recording medium M passes between transferring roller 8 and photoconductor 1 in a direction of arrow e. Transferring roller 8 is fed with a voltage (transfer bias) having a polarity opposite to that of the toner particles in the toner image. At the nip portion (transferring portion 8T) between transferring roller 8 and photoconductor 1, the toner image is transferred from photoconductor 1 onto recording medium M. The toner image is formed on the recording surface of recording medium M.

Recording medium M having the toner image carried thereon is sent to a fixing device not shown in the figure. The fixing device fixes the toner image on recording medium M. The carrier liquid and the toner both having not been transferred and remaining on photoconductor 1 are removed from the surface of photoconductor 1 by cleaning blade 9. Charges (latent image potential) remaining on the surface of photoconductor 1 are removed by light exposure provided by eraser lamp 10. Wet-type image formation apparatus 100 repeats the above-described processes to sequentially form images on a plurality of recording media.

(Conveyance Amount Control Unit)

Although mentioned later for details, the amount of the liquid developer (toner thin layer) conveyed to developing portion 4 by the rotation of developing roller 5 is set at a suitable value through setting flows ST100, ST200 (see FIG. 7 and FIG. 8). In order to increase/decrease the amount of the liquid developer (toner thin layer) conveyed to developing portion 4, there is a method of providing a difference between the rotating speed of developing roller 5 and the rotating speed of feeding roller 6, for example.

Figure 3:
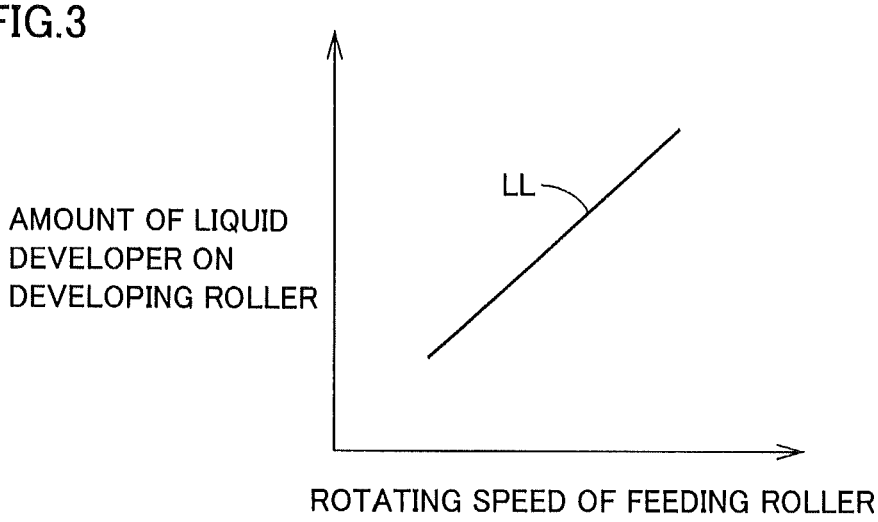
FIG. 3 shows a relation between an amount of liquid developer supplied to a developing roller and a ratio of rotating speed of a feeding roller to rotating speed of the developing roller.

With reference to FIG. 3, as indicated by a line LL, the amount of the liquid developer supplied to developing roller 5 is changed according to a ratio of the rotating speed of feeding roller 6 to the rotating speed of developing roller 5. For example, when the movement speed of the surface of feeding roller 6 is made faster than the movement speed of the surface of developing roller 5 at the rolling contact portion between feeding roller 6 and developing roller 5, the amount of the liquid developer supplied to the rolling contact portion is increased, with the result that the conveyance amount of the liquid developer on developing roller 5 is increased.

The rotating speed of feeding roller 6 is changed by a driving device 6N (FIG. 2) and an adjusting device 6M (FIG. 2). In the present embodiment, feeding roller 6, driving device 6N and adjusting device 6M correspond to a conveyance amount control unit for controlling the amount of the toner conveyed to developing portion 4. The conveyance amount of the toner in the liquid developer conveyed to the developing portion is adjusted by control device 20 controlling the conveyance amount control unit based on image densities of patch images detected by optical sensor 30 (detecting unit) as described below.

(Charge Amount Control Unit)

Although mentioned later for details, the charge amount of the liquid developer charged by charger 5C is also set at a suitable value through setting flows ST100, ST200 (see FIG. 7 and FIG. 8). As a method of adjusting the charge amount of the toner in the liquid developer, there is a method of adjusting the charge amount of the toner in the liquid developer by measuring current flowing into developing roller 5 during the charging of the toner and increasing/decreasing, based on the measurement result, the voltage applied to charger 5C (output).

The voltage applied to charger 5C is changed by a power supply device 5N (FIG. 2) and an adjusting device 5M (FIG. 2). In the present embodiment, charger 5C, power supply device 5N, and adjusting device 5M correspond to a charge amount control unit for controlling the charge amount of the toner in the liquid developer conveyed to developing portion 4. The charge amount of the toner in the liquid developer conveyed to the developing portion is adjusted by control device 20 controlling the charge amount control unit based on image densities of patch images detected by optical sensor 30 (detecting unit) as described below. The output of charger 5C may be controlled using not only the voltage applied to charger 5C but also current supplied to charger 5C.

(Detecting Unit)

Optical sensor 30 serving as the detecting unit is a so-called "reflection type optical sensor". Optical sensor 30 is disposed to face a portion of the surface of photoconductor 1 at a downstream relative to developing portion 4 in the rotation direction of photoconductor 1 and at an upstream relative to transferring portion 8T. Optical sensor 30 includes an LED (Light Emitting Diode) and a photo diode, for example.

The LED emits detection light. The detection light is emitted to the surface of photoconductor 1 and the toner image (patch image) carried on the surface of photoconductor 1. Light reflected by the surface of photoconductor 1 and the toner image is received by the photo diode. A voltage corresponding to an amount of received light is output as a sensor output, which is sent to control device 20 (FIG. 2). Information about the sensor output is stored in a storage device 21 as the image density of the toner image.

The surface of photoconductor 1 (also referred to as "naked surface" or "bare surface") has a smooth shape. A portion of the detection light emitted to the surface of photoconductor 1 is likely to be mirror-reflected (regularly reflected) by the surface of photoconductor 1. Because the portion of the detection light emitted to the surface of photoconductor 1 is mirror-reflected by the surface of photoconductor 1, a large amount of reflected light is received. In the surface of photoconductor 1, the amount of reflected light received becomes large and the sensor output also becomes high at a region in which the area of a portion at which the surface of photoconductor 1 is exposed is larger than the area of a portion having toner particles existing thereon.

On the other hand, a portion of the detection light emitted to toner particles on the surface of photoconductor 1 is irregularly reflected by the surfaces of the toner particles or is absorbed in the toner particles and pigment of the toner particles. Regarding the portion of the detection light emitted to the toner particles of photoconductor 1, a small amount of reflected light is received. In the surface of photoconductor 1, the amount of reflected light received becomes small and the sensor output also becomes low at the region in which the area of the portion at which the surface of photoconductor 1 is exposed is smaller than the area of the portion having toner particles existing thereon.

Based on the sensor output from optical sensor 30, the image density of the toner image (patch image) formed on photoconductor 1 can be detected. Control device 20 (FIG. 2) employs such a fact that the amount of received light is changed depending on a magnitude of coverage of the toner, so as to detect coverage of toner in a certain area as the image density of the toner image. Based on the image density as the detection result, control device 20 controls the conveyance amount control unit and the charge amount control unit to respectively adjust the conveyance amount and charge amount of the toner in the liquid developer conveyed to the developing portion.

(Liquid Developer)

As described above, as main components, liquid developer 7W includes: insulating liquid serving as carrier liquid; toner (toner particles) made of a coloring agent, a resin, and the like; a dispersant for dispersing the toner in the carrier liquid. In the present embodiment, 100 parts of polyester resin and 15 parts of copper phthalocyanine are sufficiently mixed with each other using a Henschel Mixer®. Then, this mixture is subjected to a melt kneading treatment using an extruder that has twin screws rotating in the same direction and that has a roll in which a heating temperature is set at 100° C. A resulting mixture is cooled and coarsely pulverized, thereby obtaining coarsely pulverized toner particles.

75 parts of IPS2028 (provided by Idemitsu Kosan Co., Ltd), 25 parts of the coarsely pulverized toner particles, and 0.8 part of V216 (provided by IPS) serving as a dispersant are mixed with one another, and then are wet-pulverized using a sand mill for 4 days, thereby obtaining liquid developer 7W. Each of the toner particles has a particle size of 2.0 μm. The value of the particle size of the toner particle is measured using a laser diffraction type particle size distribution measuring device (SALD-2200 (provided by Shimadzu Corporation)).

(Developing Characteristic)

Figure 4:
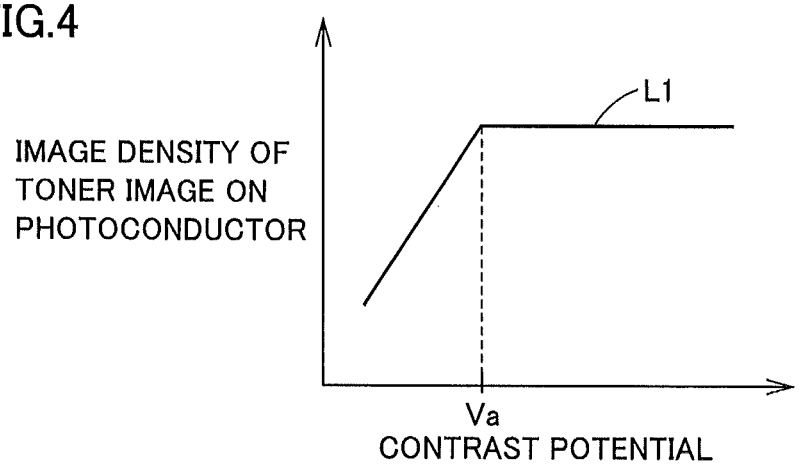
FIG. 4 shows a developing characteristic of the wet-type image formation apparatus.

With reference to FIG. 4, the following describes the developing characteristic of wet-type image formation apparatus 100. FIG. 4 shows a relation between the contrast potential and the image density (amount of toner adhered to the photoconductor) of the toner image formed on the photoconductor. The contrast potential is a value determined by a difference between the developing bias applied to the developing roller and the surface potential of the photoconductor at the print portion after light exposure. When the surface potential of the photoconductor is constant, the contrast potential becomes higher as the developing bias is higher.

For example, assume that the developing bias applied to the developing roller is increased and the contrast potential (potential after light exposure) between the developing roller and the photoconductor is increased while the amount of the liquid developer conveyed to the developing portion and the charge amount of the toner particles are set at constant values (see a line L1). In this case, as the electric field generated in the developing portion is increased, the amount of the toner moving from the developing roller to the photoconductor (the amount of the toner adhered to the photoconductor) is also increased. The image density of the toner image (patch image) formed on the photoconductor is also increased. After the contrast potential becomes equal to or larger than a certain value Va, the toner cannot be moved any more, with the result that the image density of the toner image (patch image) is not increased any more and is therefore saturated.

In a range equal to or more than contrast potential Va (also referred to as "saturation contrast potential"), the image density of the toner image on the photoconductor is substantially saturated. Even if image formation conditions such as developing bias, charging bias, and exposure energy are varied slightly, the image density of the toner image (patch image) formed in the range equal to or larger than saturation contrast potential Va is substantially unchanged. In a wet-type electrophotographic method, the contrast potential is generally set to be equal to or larger than saturation contrast potential Va.

Here, the expression "the image density of the toner image on the photoconductor is substantially saturated" is intended to mean that an amount of toner contributing to visualization of an electrostatic latent image is substantially unchanged even if the contrast potential is varied. The case where "the image density of the toner image on the photoconductor is substantially saturated" includes not only a case where all the toner in the liquid developer on the developing roller is adhered onto the photoconductor, but also a case where the image density of the toner image on photoconductor 1 is substantially unchanged while a predetermined ratio (for example, 90%, 95%, or more) of the toner in the liquid developer on the developing roller is adhered to the photoconductor even when the contrast potential is changed due to an influence of change in characteristic of the photoconductor or each of the rollers.

Figure 5:
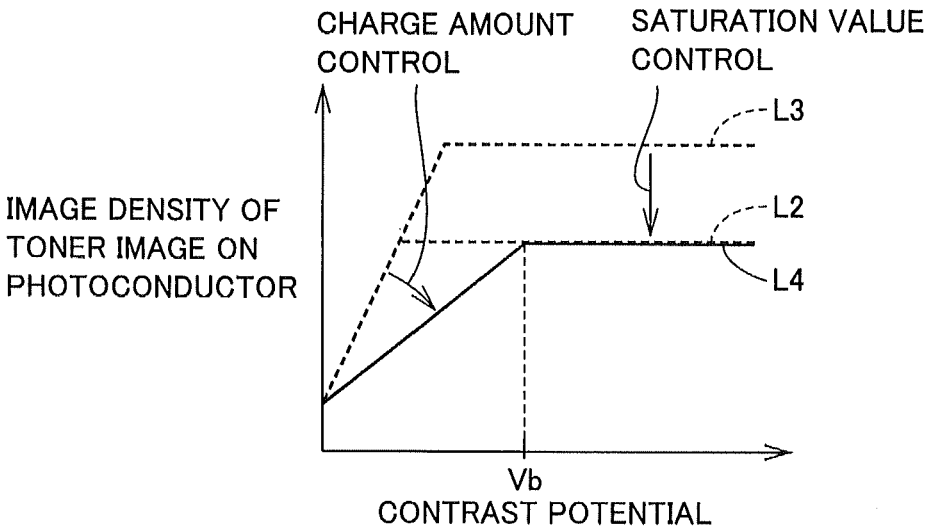
FIG. 5 shows the developing characteristic of the wet-type image formation apparatus, illustrating that a charge amount is controlled and that a saturation value is controlled.

With reference to FIG. 5, each of lines L2 to L4 in FIG. 5 also indicates a relation between the contrast potential and the image density of the toner image on the photoconductor. For example, the characteristic represented by line L4 indicates a relation between the contrast potential and the image density when the charge amount of the toner in the liquid developer conveyed to the developing portion is made higher than that in the case of line L2 (dotted line). As the charge amount of the toner is increased, the charge amount of each toner particle becomes high, with the result that the contrast potential is canceled by a small amount of toner.

At a low contrast potential portion, the development is ended by the charges of the toner canceling the contrast potential. Hence, as the charge amount of the toner becomes higher, inclination of the developing efficiency, which indicates increase of the image density of the toner image relative to the contrast potential, becomes smaller. In other words, the inclination of the developing efficiency is decreased. On the other hand, when the charge amount of the toner is decreased, the charge amount of each toner particle becomes low, with the result that the contrast potential is canceled by a larger amount of toner. The inclination of the developing efficiency indicating the increase of the image density of the toner image relative to the contrast potential becomes large. The inclination of the developing efficiency is increased.

In other words, at the low contrast potential portion (contrast potential not more than saturation contrast potential Vb), irrespective of the amount of the toner conveyed to the developing portion (the amount of the toner on the developing roller), the amount of the toner adhered to photoconductor 1 is determined according to the charge amount of the toner. As the contrast potential becomes higher, more charges are necessary to cancel the potential, thereby increasing the amount of the toner to be developed. As the contrast potential becomes further higher, charges necessary to cancel the contrast potential becomes equal to the charges of the toner, whereby substantially all the toner on the developing roller is provided for development. The potential on this occasion corresponds to saturation contrast potential Vb.

Even when the contrast potential becomes higher than saturation contrast potential Vb, the image density (toner amount) of the toner image on the photoconductor is not increased and becomes constant because substantially all the toner on the developing roller is provided for development. It should be noted that when the saturation state is reached, the contrast potential has not been completely canceled yet. On the other hand, the image density of the toner image after reaching the saturation value of the developing characteristic is determined uniquely according to the amount of the toner in the liquid developer supplied from the feeding roller to the developing roller (see dotted line L3). The image density (amount of toner) of the toner image, having reached the saturation state, on the photoconductor can be set at a desired value by controlling an amount of developer in the course of forming a thin layer.

Figure 6:
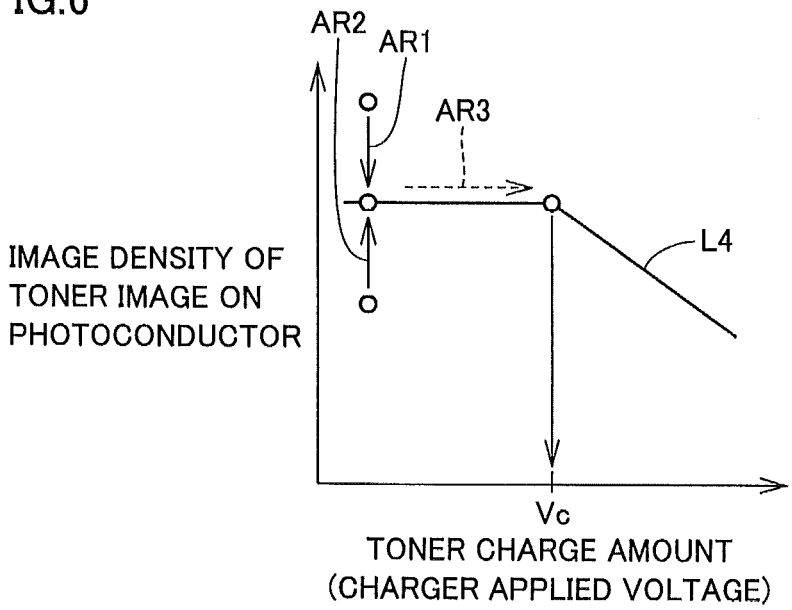
FIG. 6 is a diagram for illustrating a relation between the charge amount of the toner (voltage applied to a charger) and image density of a toner image on a photoconductor.

With reference to FIG. 6, the following describes a relation between the charge amount of the toner (voltage applied to the charger) and the image density of the toner image on the photoconductor. FIG. 6 shows a change in image density in response to a change in the charge amount of the toner in the developing portion when the contrast potential is set at a constant value (standard contrast potential) equal to or more than the saturation contrast potential. When the charge amount of the toner is increased with the contrast potential being set at the constant value as described above, the developing efficiency is changed from the characteristic represented by dotted line L2 in FIG. 5 to the characteristic represented by line L4 in FIG. 5.

Assume that the conveyance amount of the toner conveyed to the developing portion is adjusted (see arrows AR1, AR2 in FIG. 6) and the contrast potential is set at a value (constant value) with which the image density of the toner image is saturated in the state of line L4 in FIG. 6. When increasing the charge amount of the toner in this state (see arrow AR3 in FIG. 6), the image density of the toner image remains saturated until a certain charge amount Vc. However, when further increasing the charge amount, the developing efficiency is decreased to decrease the image density of the toner image. This is because as the charge amount of the toner becomes higher, the inclination of the developing efficiency indicating the increase of the image density of the toner image relative to the contrast potential becomes small as described with reference to FIG. 5.

As the charge amount of the toner in the liquid developer conveyed to the developing portion is further increased after the charge amount of the toner exceeds charge amount Vc, a continuously downward inclination portion is formed as the detection result for the image density of the toner image formed on the photoconductor. This inclination portion indicates a characteristic such that as the charge amount of the toner is increased, the image density of the toner image as the detection result is decreased. This is due to the following reason: the movement of the toner from the developing roller to the photoconductor takes place due to the charges of the toner canceling the contrast potential, so that when the charge amount of the toner is high, the contrast potential is canceled by a small amount of toner, with the result that the developing efficiency is decreased.

In the continuously downward inclination portion in which the developing efficiency is decreasing, irrespective of the conveyance amount of the toner conveyed to the developing portion by the developing roller, the amount of the toner movable from the developing roller to the photoconductor is determined by the contrast potential and the charge amount of the toner. In the continuously downward inclination portion in which the developing efficiency is decreasing, the image density relative to the charge amount of the toner is the same irrespective of whether the conveyance amount of the toner conveyed to the developing portion by the developing roller is large or small. In other words, in the continuously downward inclination portion in which the developing efficiency is decreasing, the amount of the toner on the photoconductor (the image density of the toner image on the photoconductor) is determined by the charge amount of the toner and the contrast potential.

As described above, the charge amount of the toner has an influence over not only the developing characteristic (developing efficiency) but also the dot reproducibility and the image uniformity, so that the charge amount is preferably higher. In other words, as the charge amount of the toner is higher, reproducibility of letters/characters and dots becomes better and noise resulting from liquid turbulence becomes less. At the low contrast potential portion, as the charge amount of the toner becomes higher, the inclination of the developing efficiency indicating the increase of the image density of the toner image relative to the contrast potential is decreased. In addition, the inclination of the developing characteristic is preferably small in order to precisely form an image having an intermediate density such as a half tone. This is because even when the contrast potential is slightly varied, the influence of the variation is small as long as the developing efficiency is small.

On the other hand, in order to prevent adhesion of toner onto a background portion of the image (occurrence of a so-called "fogging phenomenon"), a potential difference, which is called "fogging margin", of the same polarity as that of the charges of the toner needs to be set. Further, the maximum value of the surface potential of the photoconductor is determined according to the characteristic of the photoconductor, so that the maximum value of the developing bias is determined uniquely by the maximum value of the surface potential of the photoconductor and the fogging margin. Hence, as the charge amount of the toner is made too high, the toner on the developing roller cannot be developed by 100% even with the maximum value of the developing bias. With the above-described matters being comprehensively considered, the developing characteristic is determined by the following procedure to prevent the occurrence of the fogging phenomenon and stably achieve formation of a good toner image.

First, in accordance with the characteristic of the photoconductor and the fogging margin, a standard developing bias (standard contrast potential) is determined. Next, the toner amount is adjusted such that the image density of the toner image (patch image) is saturated when the contrast potential is set at the standard contrast potential. This is done by adjusting the amount of the toner on the developing roller (the amount of the liquid developer conveyed to the developing portion). Thereafter, the charge amount of the toner is adjusted at the maximum value with which the amount of the toner is saturated at the standard contrast potential. Hereinafter, these adjustments will be described more in detail.

(Standard Image Formation Condition Setting Flow ST100)

In wet-type image formation apparatus 100, in order to obtain a high-quality image when performing normal image formation onto a recording medium M, a below-described standard image formation condition setting flow ST100 (see FIG. 7) is first performed. By performing standard image formation condition setting flow ST100, the image formation condition of wet-type image formation apparatus 100 is set at the standard image formation condition.

Standard image formation condition setting flow ST100 is performed, for example, just after powering on wet-type image formation apparatus 100, after continuously forming a predetermined number of images using wet-type image formation apparatus 100, and after passage of a predetermined time after forming an image by wet-type image formation apparatus 100. The timing at which standard image formation condition setting flow ST100 is performed is recorded in storage device 21 (FIG. 2). When control device 20 (FIG. 2) determines that the predetermined condition is satisfied, control device 20 sends an instruction for performing standard image formation condition setting flow ST100, to each device included in wet-type image formation apparatus 100.

(Step ST110)

In standard image formation condition setting flow ST100, the developing bias is first set at a standard value. A fogging margin required for good image formation is determined based on the limit of surface potential to which the photoconductor can be charged, the conveyance amount of the toner conveyed to the developing portion, and the charge amount of the toner conveyed to the developing portion. The standard value (standard contrast potential) of the developing bias is determined based on the surface potential of the photoconductor and the fogging margin.

Next, the charge amount and conveyance amount of the toner in the liquid developer conveyed to the developing portion are determined. Specifically, with the contrast potential being set at the above-described standard contrast potential, the voltage applied to charger 5C is set at a low value (temporary setting value) such that the image density of the toner image after development becomes the saturation value even when the conveyance amount of the toner is large. The rotating speed of feeding roller 6 is set at a predetermined value (temporary setting value).

(Step ST120)

Under the above-described setting, the conveyance amount of the toner conveyed to developing portion 4 (liquid developer amount) is adjusted. Specifically, a patch image is formed on the surface of photoconductor 1 by controlling exposure device 3 and the like (step ST121). The image density of the patch image is detected using optical sensor 30 (step ST122). Control device 20 determines whether or not the detection result falls within a target density range (step ST123).

When the image density of the patch image falls out of the target density range (NO in step ST123), control device 20 changes the rotating speed of feeding roller 6 (step ST124). When it is determined, based on the detection result from optical sensor 30, that the conveyance amount of the toner is small, the rotating speed of feeding roller 6 is made faster. When it is determined, based on the detection result from optical sensor 30, that the conveyance amount of the toner is large, the rotating speed of feeding roller 6 is made slower.

Figure 7:
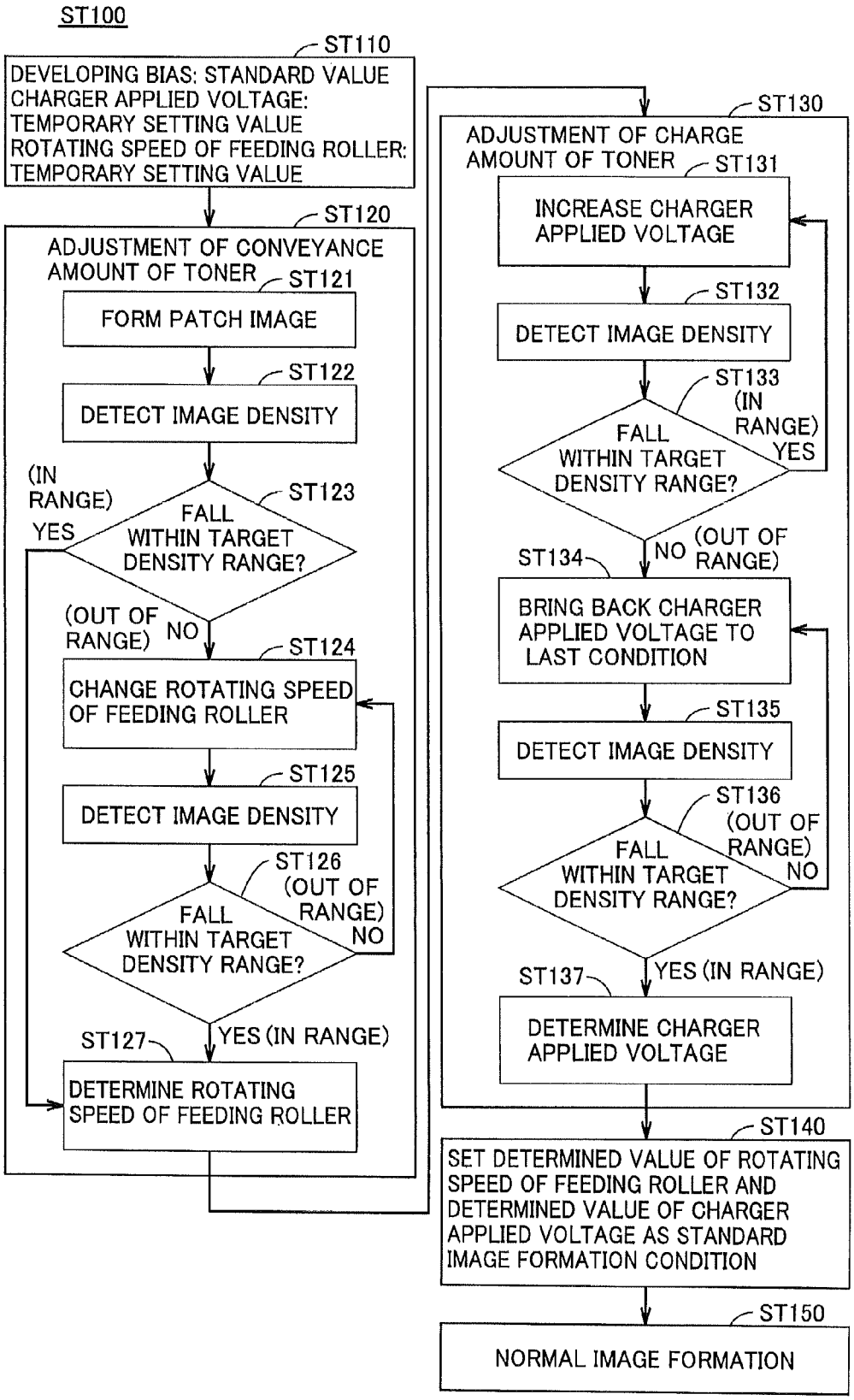
FIG. 7 is a flowchart showing a standard image formation condition setting flow ST100 for the wet-type image formation apparatus in the first embodiment.

After changing the rotating speed of feeding roller 6, a patch image is formed on the surface of photoconductor 1 by controlling exposure device 3 and the like again, although not shown in FIG. 7. The image density of the patch image is detected using optical sensor 30 (step ST125). Control device 20 determines whether or not the detection result falls within a target density range (step ST126). Until the image density of the patch image falls within the target density range, steps ST124 to ST126 are repeated.

When the image density of the patch image falls within the target density range (YES in step ST123 or YES in step ST126), the rotating speed of feeding roller 6 is determined (step ST127). The conveyance amount of the toner conveyed to developing portion 4 by developing roller 5 is determined. Information about the rotating speed of feeding roller 6 (in other words, information about the conveyance amount of the toner) is stored in storage device 21.

(Step ST130)

Next, the charge amount of the toner in the liquid developer conveyed to developing portion 4 is adjusted. At this point of time, as described above, the voltage applied to charger 5C is set at the low value (temporary setting value). Control device 20 increases the voltage applied to charger 5C (step ST131). Although not shown in FIG. 7, a patch image is formed on the surface of photoconductor 1 by controlling exposure device 3 and the like again. The image density of the patch image is detected using optical sensor 30 (step ST132). Control device 20 determines whether or not the detection result falls within the target density range (step ST133).

Even though the voltage applied to charger 5C is increased, the image density of the patch image indicates a substantially constant value until the voltage applied to charger 5C reaches a certain value (value corresponding to charge amount Vc in FIG. 6). Steps ST131 to ST133 are repeated until the image density of the patch image falls out of the target density range. When the voltage applied to charger 5C exceeds the certain value (value corresponding to charge amount Vc in FIG. 6), the image density of the patch image starts to be decreased (NO in step ST133).

Control device 20 brings the voltage applied to charger 5C back to the last value from the value for the condition under which the image density of the patch image starts to be decreased (step ST134). A patch image is formed on the surface of photoconductor 1 and the image density of the patch image is detected (step ST135). Control device 20 checks whether or not the image density of the patch image is controlled to fall within the target density range (step ST136). When NO in step ST136, the voltage applied to charger 5C is brought back to the second last value from the value for the condition under which the image density of the patch image starts to be decreased. Steps ST134 to ST136 are repeated until it is confirmed that the image density of the patch image has been controlled to fall within the target density range.

With the image density of the patch image falling within the target density range (YES in step ST136), the voltage applied to charger 5C is determined (step ST137). The charge amount of the toner in the liquid developer conveyed to developing portion 4 by developing roller 5 is determined. Information about the voltage applied to charger 5C (in other words, information about the charge amount of the toner) is stored in storage device 21.

The value of the rotating speed of feeding roller 6 is adjusted through step ST120, the value of the voltage applied to charger 5C is adjusted through step ST130, and the condition at the point of time of completion of the adjustments is set in wet-type image formation apparatus 100 as the standard image formation condition (step ST140). Wet-type image formation apparatus 100 performs the normal image formation in such a state that it is set at this standard image formation condition (step ST150).

Under the standard image formation condition (standard developing characteristic), even when the contrast potential is increased to reach or exceed the predetermined standard contrast potential, the image density of the toner image is saturated and becomes constant and the image density of the patch image having become constant falls within the target density range. Wet-type image formation apparatus 100 set at the standard image formation condition can perform image formation under an appropriate developing characteristic.

(Image Formation Condition Setting Flow ST200)

Described next is an image formation condition setting flow ST200 performed while outputting images (for example, while continuously forming images).

When continuously forming images under the standard image formation condition (standard developing characteristic) set in standard image formation condition setting flow ST100 (FIG. 7), the conveyance amount of the toner conveyed to developing portion 4 may be varied or the charge amount of the toner in the liquid developer conveyed to developing portion 4 may be varied due to influences such as a change in environment around the apparatus and a period of use of the apparatus. The variation of each characteristic causes variation of the amount of the toner supplied to an electrostatic latent image, and also affects the density of an image finally formed on a recording medium.

Assume that while continuously forming images, the image formation condition is optimized by performing adjustments similar to those in the above-described standard image formation condition setting flow ST100. In this case, it is difficult to shorten a time required for the adjustments because the adjustments needs to be performed in order in such a manner that the amount of the liquid developer on the developing roller is adjusted and thereafter the charge amount of the toner conveyed to the developing portion is adjusted. While performing the adjustments similar to those in standard image formation condition setting flow ST100, a normal image cannot be formed, thus leading to decrease of productivity.

Figure 8:
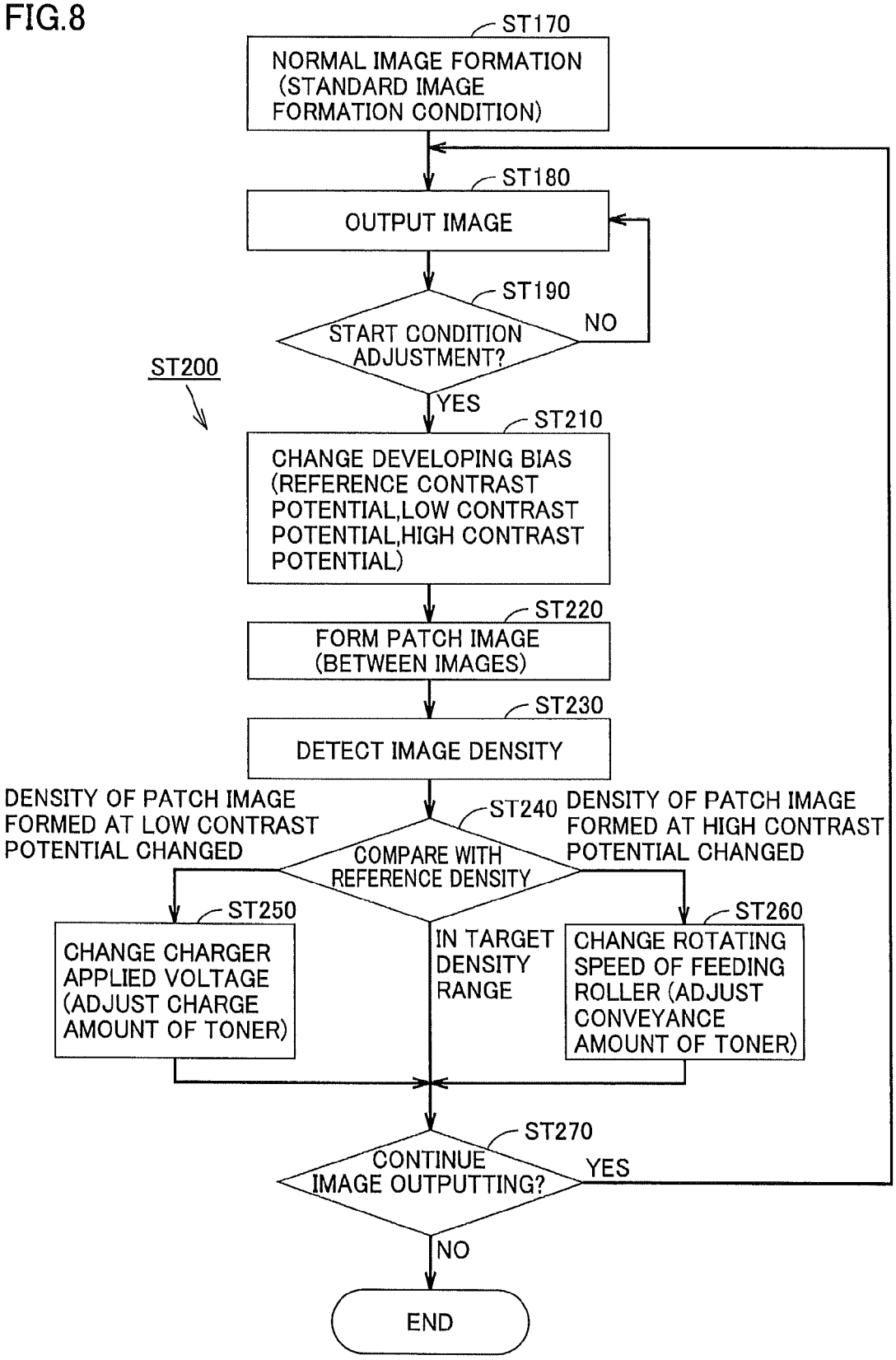
FIG. 8 is a flowchart showing an image formation condition setting flow ST200 for the wet-type image formation apparatus in the first embodiment.

With reference to FIG. 8, in wet-type image formation apparatus 100 of the present embodiment, control device 20 determines whether or not the predetermined condition is satisfied, while performing the normal image formation (steps ST170, 180). For example, when a predetermined number of sheets of images are formed by wet-type image formation apparatus 100, control device 20 determines that the condition for starting image formation condition setting flow ST200 has been satisfied, and image formation condition setting flow ST200 is started (YES in step ST190). Control device 20 sends an instruction for performing image formation condition setting flow ST200, to each device included in wet-type image formation apparatus 100.

When image formation condition setting flow ST200 is started, control device 20 changes the developing bias (step ST210). Control device 20 changes the developing bias to set the currently set contrast potential (standard contrast potential) to each of a low contrast potential lower than the standard contrast potential and a high contrast potential higher than the standard contrast potential.

Here, assume that wet-type image formation apparatus 100 forms a plurality of images with wet-type image formation apparatus 100 being set at the standard image formation condition. For example, when photoconductor 1 made of a-Si is used, the surface potential of photoconductor 1 has an upper limit of about 600 V. Supposing that the fogging margin is secured only for 150 V, the developing bias that can be set as standard developing bias is 450 V. On this occasion, when the surface potential of photoconductor 1 after light exposure is 50 V, the standard contrast potential is 400 V. While wet-type image formation apparatus 100 is set at the standard image formation condition, the rotating speed of feeding roller 6 and the voltage applied to charger 5C are adjusted in advance such that the image density of the patch image is saturated and the image density at the time of saturation falls within the target density range even when the contrast potential is set to be equal to or more than the standard contrast potential.

Figure 9:
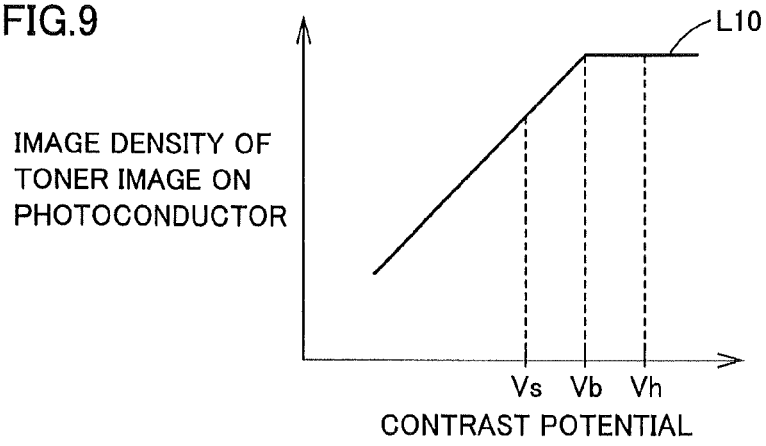
FIG. 9 shows the standard developing characteristic of the wet-type image formation apparatus in the first embodiment.

Assume that wet-type image formation apparatus 100 has such a developing characteristic as indicated by line L1 in FIG. 9, at a certain timing while the normal image formation is being performed. By setting the developing bias at 400 V for the contrast potential (standard contrast potential Vb), the contrast potential can be a low contrast potential Vs (see FIG. 9), which is a potential decreased by 50V from the standard contrast potential. By setting the developing bias at 500 V, the contrast potential can be a high contrast potential Vh (see FIG. 9), which is a potential increased by 50 V from the standard contrast potential.

When performing image formation condition setting flow ST200 during image formation (during image outputting), control device 20 forms a patch image with the contrast potential being set at standard contrast potential Vb. Then, control device 20 changes the contrast potential, forms a patch image with the contrast potential being set at high contrast potential Vh, and forms a patch image with the contrast potential being set at low contrast potential Vs (step ST220).

Figure 10:
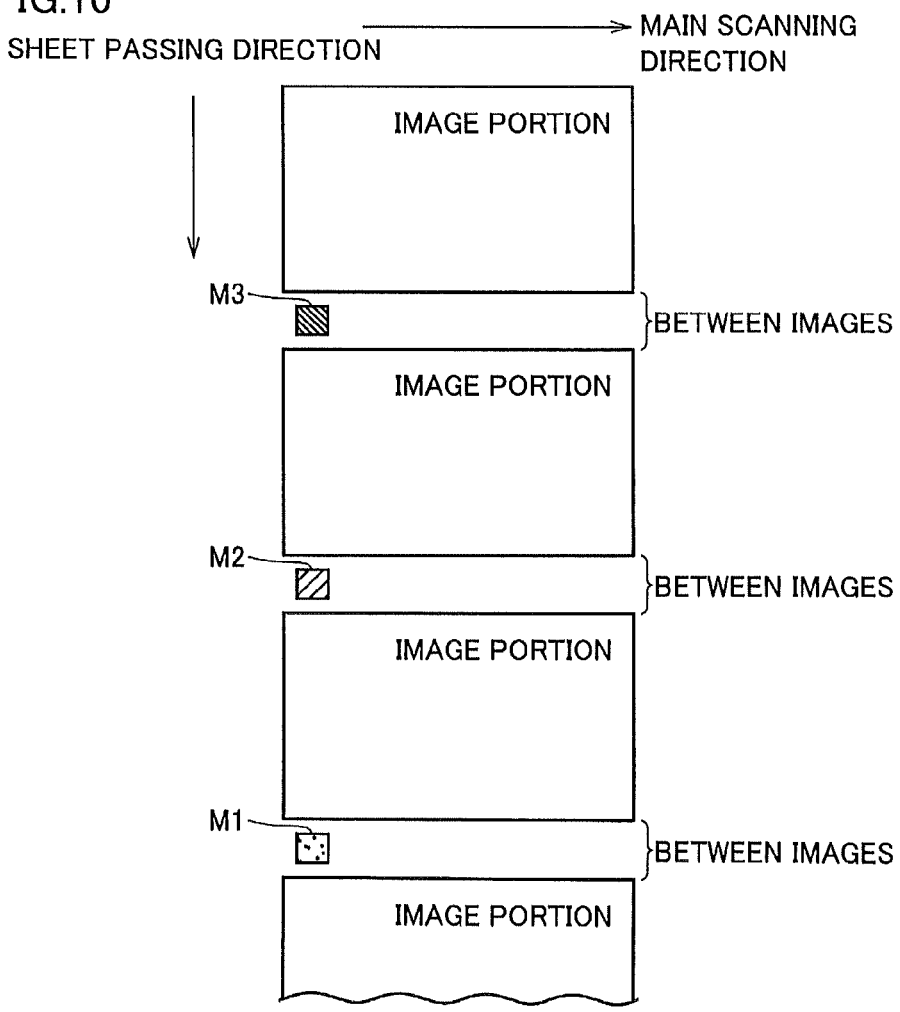
FIG. 10 shows that the wet-type image formation apparatus in the first embodiment forms a patch image between images.

As shown in FIG. 10, in the present embodiment, patch images M1, M2, M3 are formed in regions external to image portions during image formation. By changing the developing bias among the images, the plurality of patch images M1, M2, M3 can be formed at different contrast potentials. Patch image M1 is formed with the contrast potential being set at standard contrast potential Vb, for example. Patch image M2 or M3 is formed with the contrast potential being set at high contrast potential Vh or low contrast potential Vs.

Regarding the patch images, as shown in FIG. 10, one patch image may be formed whenever one sheet of image is formed, or one patch image may be formed whenever a plurality of images are formed. Although described in detail in a third embodiment, the plurality of patch images M1, M2, M3 may be formed at different contrast potentials not only by changing the developing bias among the images but also by changing an amount of light exposure provided by exposure device 3.

Control device 20 measures three image densities of patch images M1, M2, M3 using optical sensor 30, respectively (step ST230 in FIG. 8). The detection on the image densities of patch images M1, M2, M3 can be performed only by one optical sensor 30 and can be therefore implemented at low cost. Wet-type image formation apparatus 100 performs the image formation while being set at the standard image formation condition (standard developing characteristic) in standard image formation condition setting flow ST100 (FIG. 7), and the detection results for the image densities of the plurality of patch images are obtained in the form of results shown in FIG. 11 or FIG. 12. Hereinafter, this will be specifically described.

(Case of Change in Toner Conveyance Amount)

Figure 11:
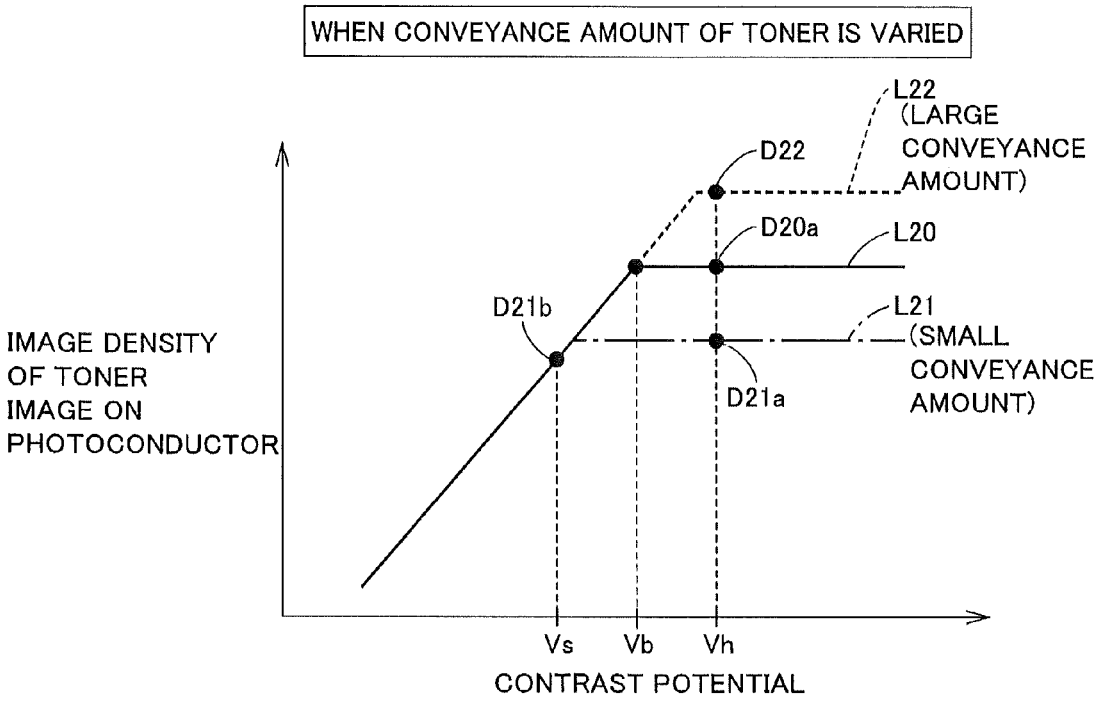
FIG. 11 shows the standard developing characteristic of the wet-type image formation apparatus in the first embodiment and a state in which the conveyance amount of the toner is varied.

With reference to FIG. 11, a line L2 in the figure represents a standard developing characteristic obtained by performing standard image formation condition setting flow ST100 (FIG. 7). At the time of completion of standard image formation condition setting flow ST100, wet-type image formation apparatus 100 has the standard developing characteristic represented by line L2, and information about line L20 is stored in storage device 21.

Assume that the conveyance amount of the toner has been decreased at a certain timing during the normal image formation due to a change in environment around the apparatus or the like. In this case, the developing characteristic is changed from the developing characteristic represented by line L2 (standard developing characteristic) to a developing characteristic represented by a line L2. At the present time at which the conveyance amount of the toner has been decreased, the image density of the patch image formed at high contrast potential Vh attains a value represented by a point D21a. On the other hand, the image density of the patch image formed at low contrast potential Vs attains a value represented by a point D21b. Although point D21b is on line L2 (standard developing characteristic), point D21a attained at high contrast potential Vh is a value varied from line L2 (standard developing characteristic).

In contrast to the above case, assume that the conveyance amount of the toner has been increased at a certain timing during the normal image formation, due to a change in environment around the apparatus or the like. In this case, the developing characteristic is changed from the developing characteristic represented by line L20 (standard developing characteristic) to a developing characteristic represented by a line L22. At the present time at which the conveyance amount of the toner has been increased, the image density of the patch image formed at high contrast potential Vh attains a value represented by a point D22 . On the other hand, the image density of the patch image formed at low contrast potential Vs attains the same value as the value represented by a point D21b. While point D21b is on line L20 (standard developing characteristic), point D22 attained at high contrast potential Vh is a value varied from line L20 (standard developing characteristic).

When the conveyance amount of the toner is appropriate, the image density of the patch image formed at high contrast potential Vh should be on line L20 (standard developing characteristic) (in other words, the density represented by point D20a should be attained), but the image density of the patch image formed at high contrast potential Vh is varied as described above when the conveyance amount of the toner (the amount of the liquid developer on developing roller 5) is varied. Therefore, when the image density of the patch image formed at high contrast potential Vh is varied from line L20 (standard developing characteristic), it can be determined that the conveyance amount of the toner is varied (step ST240 in FIG. 8).

In the present embodiment, the patch image is formed with the contrast potential being set at standard contrast potential Vb. Based on the image density of the patch image formed at standard contrast potential Vb, an amount of deviation from line L20 (standard developing characteristic) is calculated, and while making reference to a correction table or the like stored in storage device 21 in advance, the rotating speed of feeding roller 6 is controlled to adjust the conveyance amount of the toner (step ST260 in FIG. 8). When it is determined that the density of the patch image formed at high contrast potential Vh is low and the conveyance amount of the toner is small, the rotating speed of feeding roller 6 relative to that of developing roller 5 is made faster. When it is determined that the density of the patch image formed at high contrast potential Vh is high and the conveyance amount of the toner is large, the rotating speed of feeding roller 6 relative to that of developing roller 5 is made slower.

(Case of Change in Charge Amount of Toner)

Figure 12:
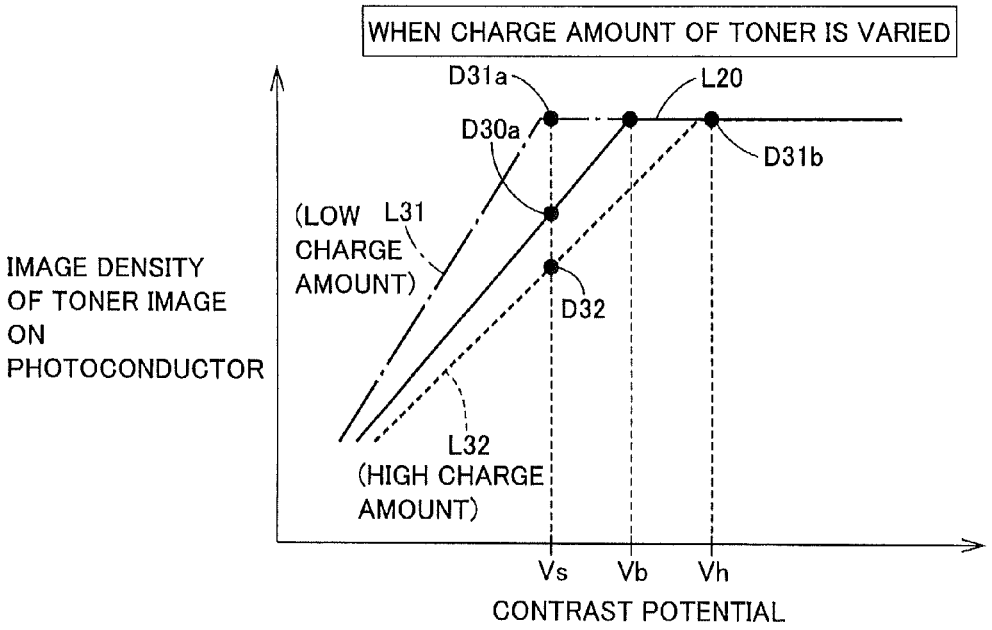
FIG. 12 shows the standard developing characteristic of the wet-type image formation apparatus in the first embodiment and a state in which the charge amount of the toner is varied.

With reference to FIG. 12, line L20 in the figure represents a standard developing characteristic obtained by performing standard image formation condition setting flow ST100 (FIG. 7). At the time of completion of standard image formation condition setting flow ST100, wet-type image formation apparatus 100 has the standard developing characteristic represented by line L20, and information about line L20 is stored in storage device 21.

Assume that the charge amount of the toner is low at a certain timing during the normal image formation due to a change in environment around the apparatus or the like. In this case, the developing characteristic is changed from the developing characteristic represented by line L20 (standard developing characteristic) to a developing characteristic represented by a line L31. At the present time at which the charge amount of the toner is low, the image density of the patch image formed at low contrast potential Vs attains a value represented by a point D31a. On the other hand, the image density of the patch image formed at high contrast potential Vh attains a value represented by a point D31b. Although point D31b is on line L20 (standard developing characteristic), point D31a attained at low contrast potential Vs is a value varied from line L20 (standard developing characteristic).

In contrast to the above case, assume that the charge amount of the toner is high at a certain timing during the normal image formation, due to a change in environment around the apparatus or the like. In this case, the developing characteristic is changed from the developing characteristic represented by line L20 (standard developing characteristic) to a developing characteristic represented by a line L32. At the present time at which the charge amount of the toner is high, the image density of the patch image formed at low contrast potential Vs attains a value represented by a point D32. On the other hand, the image density of the patch image formed at high contrast potential Vh attains the same value as the value represented by a point D31b. Although point D31b is on line L20 (standard developing characteristic), point D32 attained at low contrast potential Vs is a value varied from line L20 (standard developing characteristic).

When the charge amount of the toner is appropriate, the image density of the patch image formed at low contrast potential Vs should be on line L20 (standard developing characteristic) (in other words, the density represented by point D30a should be attained), but the image density of the patch image formed at low contrast potential Vs is varied as described above when the charge amount of the toner is varied. Therefore, when the image density of the patch image formed at low contrast potential Vs is varied from line L20 (standard developing characteristic), it can be determined that the charge amount of the toner is varied (step ST240 in FIG. 8).

In the present embodiment, the patch image is formed with the contrast potential being set at standard contrast potential Vb. Based on the image density of the patch image formed at standard contrast potential Vb, an amount of deviation from line L20 (standard developing characteristic) is calculated, and while making reference to a correction table or the like stored in storage device 21 in advance, the voltage applied to charger 5C is controlled to adjust the charge amount of the toner (step ST250 in FIG. 8). When it is determined that the density of the patch image formed at low contrast potential Vs is low and the charge amount of the toner is high, the voltage applied to charger 5C is decreased. When it is determined that the density of the patch image formed at low contrast potential Vs is high and the charge amount of the toner is low, the voltage applied to charger 5C is increased.

According to image formation condition setting flow ST200 in the present embodiment, the patch images are formed at the high contrast potential and low contrast potential between images, and based on the detection result for the densities thereof, it can be determined whether the conveyance amount of the toner is varied or the charge amount of the toner is varied. By controlling the rotating speed of feeding roller 6 and the voltage applied to charger 5C based on the determination result and the correction table, the developing characteristic can be brought back to an appropriate developing characteristic. Based on the detection result for the densities, sufficiency/insufficiency in the conveyance amount and sufficiency/insufficiency in the charge amount can be determined, and control over the image formation condition can be determined in one manner, thus attaining a short time necessary for the adjustments.

In the present embodiment, control device 20 adjusts the conveyance amount of the toner or the charge amount of the toner based on the correction table provided in advance and the three detection results for the image densities detected by optical sensor 30. The present invention is not limited to this configuration, and control device 20 may adjust the conveyance amount of the toner or the charge amount of the toner based on the correction table provided in advance and two detection results for image densities detected by optical sensor 30. In this case, reference is made to the detection results for the following two image densities: the image density of the patch image formed at high contrast potential Vh; and the image density of the patch image formed at low contrast potential Vs. When information for obtaining an appropriate amount of adjustment based on the two detection results for the image densities is included in the correction table, the adjustment operation can be performed more quickly.

With reference to FIG. 8 again, when it is determined, in step ST240 based on the image densities of the three patch images, that the image formation condition does not need to be adjusted, the process proceeds to step ST270, in which it is determined whether to continue the image outputting. When the image outputting is to be continued (YES in step ST270), the process is brought back to step ST180 again, thus continuing the image outputting. In the case of NO in step ST270, the image formation is ended.

Image formation condition setting flow ST200 in the present embodiment has a flow configuration such that the image formation condition is adjusted, if required, based on the image densities of the three patch images and then the process is brought back to the image outputting. After adjusting the image formation condition, in a manner similar to steps ST210 to ST240 described above, patch images may be formed again between images so as to check whether or not the image formation condition (developing characteristic) after the adjustment has become appropriate. If the adjustment is insufficient, the adjustment operation may be repeated until the image formation condition (developing characteristic) after the adjustment becomes appropriate. The image formation condition may be optimized by performing standard image formation condition setting flow ST100 again after a certain period of time has passed or a certain number of sheets have been output, while repeating image formation condition setting flow ST200 regularly.

[Second Embodiment]

Figure 13:
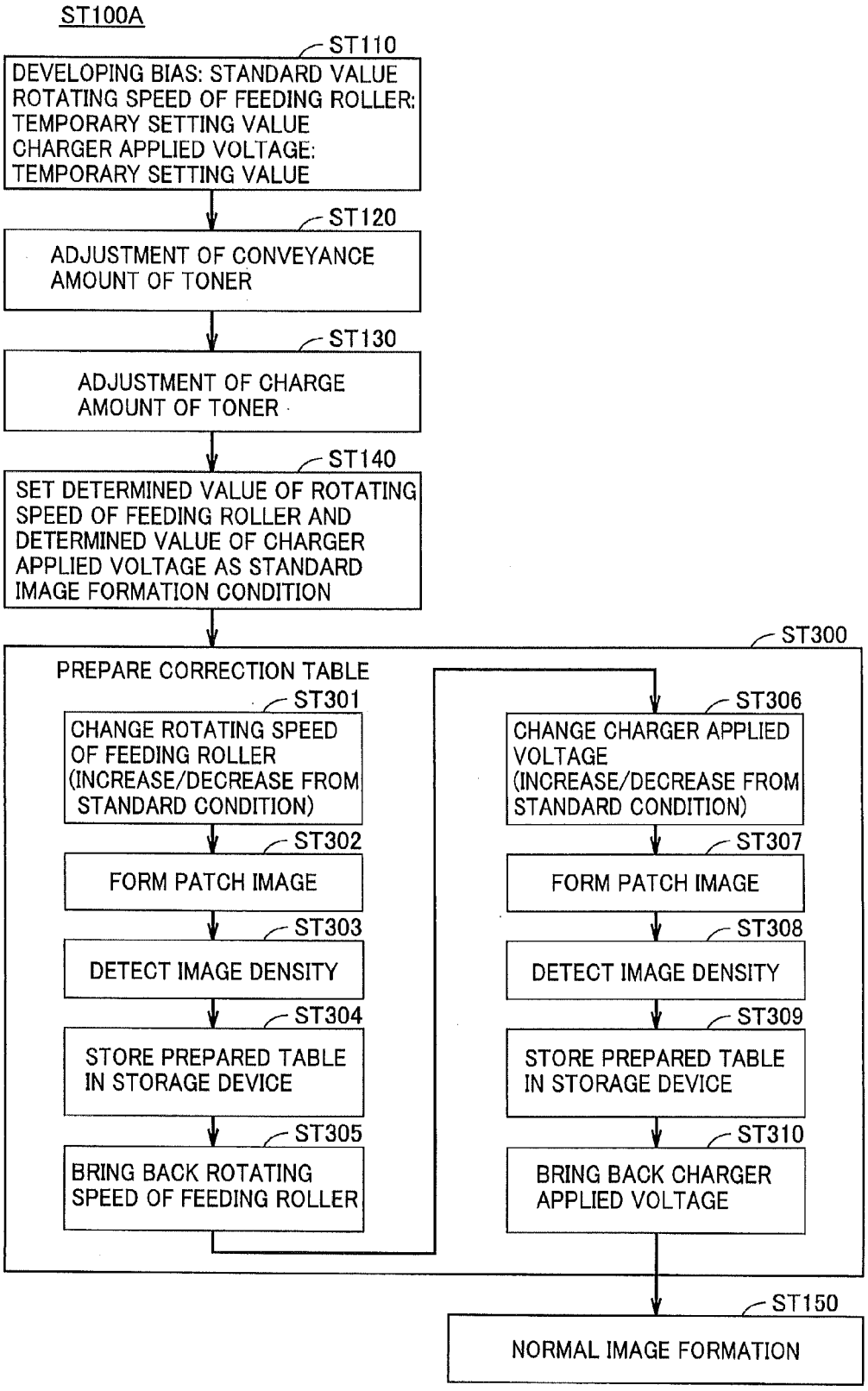
FIG. 13 is a flowchart showing a standard image formation condition setting flow ST100A for a wet-type image formation apparatus in a second embodiment.

With reference to FIG. 13, the following describes a wet-type image formation apparatus in a second embodiment. A standard image formation condition setting flow ST100A shown in FIG. 13 corresponds to a modification of standard image formation condition setting flow ST100 (FIG. 7) in the first embodiment. Steps ST110 to ST140 are the same in standard image formation condition setting flows ST100, ST100A. Standard image formation condition setting flow ST100A in the present embodiment further includes a correction table preparation flow ST300.

In the present embodiment, correction table preparation flow ST300 is performed after setting the standard image formation condition in the wet-type image formation apparatus in step ST140. In the first embodiment, in image formation condition setting flow ST200, reference is made to the correction table stored in storage device 21 in advance so as to control the rotating speed of feeding roller 6 and the voltage applied to charger 5C. In the present embodiment, the correction table referenced in image formation condition setting flow ST200 is prepared in correction table preparation flow ST300 during standard image formation condition setting flow ST100A.

Specifically, the rotating speed of feeding roller 6 is changed for a plurality of times to be increased/decreased from a standard value (value for the standard condition) (step ST301). A patch image is formed for a different rotating speed (step ST302), and the density of each patch image is detected using optical sensor 30 (step ST303). A correlation between the rotating speed of feeding roller 6 and the image density of the patch image is stored in the storage device as a correction table (step ST304).

Next, the rotating speed of feeding roller 6 is brought back to the standard value (step ST305), and the voltage applied to charger 5C is changed for a plurality of times to be increased/decreased from the standard value (value for the standard condition) (step ST306). A patch image is formed for a different applied voltage (step ST307), and the density of each patch image is detected using optical sensor 30 (step ST308). A correlation between the voltage applied to charger 5C and the image density of the patch image is stored in the storage device as a correction table (step ST309). The voltage applied to charger 5C is brought back to the standard value (step ST310).

By performing correction table preparation flow ST300, the information of the correction table is updated. By making reference to this correction table when performing image formation condition setting flow ST200 (see FIG. 8), the image formation condition can be adjusted more precisely.

[Third Embodiment]

Figure 14:
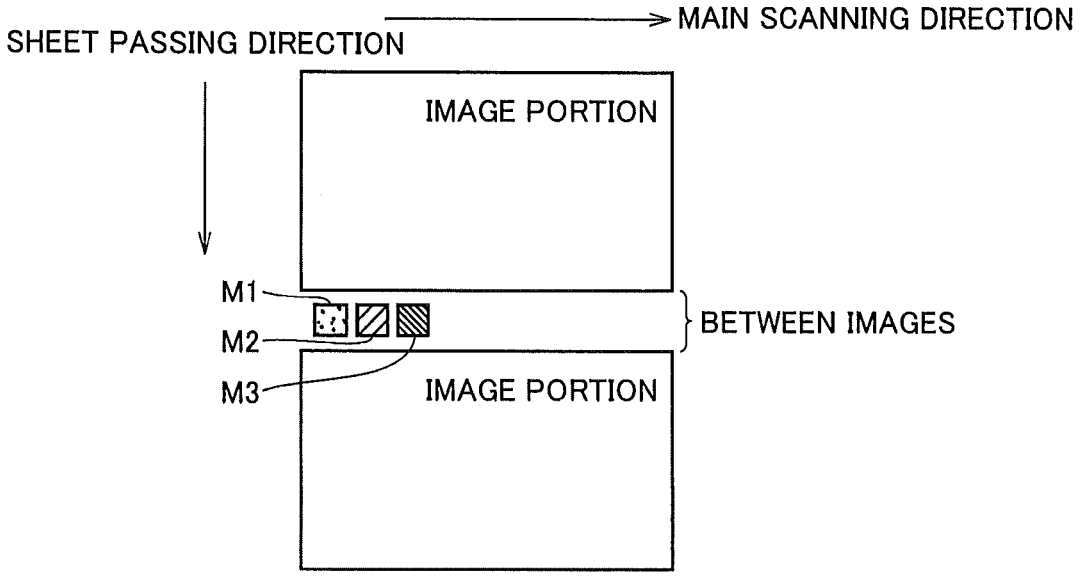
FIG. 14 shows that a wet-type image formation apparatus in a third embodiment forms patch images between images.

With reference to FIG. 14, the following describes a wet-type image formation apparatus in the present embodiment. In the first embodiment, whenever one sheet of image is formed, one patch image is formed between images (see FIG. 10). In the first embodiment, the contrast potential is changed by changing the developing bias. In the present embodiment, the contrast potential is changed by changing the amount of light exposure provided by exposure device 3.

When an LED head is used as exposure device 3 for example, the amount of light exposure can be controlled at a position in a main scanning direction as shown in FIG. 14, and images can be formed at different contrast potentials in one row in the main scanning direction. In the first embodiment, the contrast potential is changed by changing the developing bias, so that the contrast potential can be changed only in the sheet passing direction, thus resulting in a long time necessary to form patch images as well as a long time necessary to detect the image density of each patch image.

On the other hand, in the present embodiment, patch images can be formed in one row in the main scanning direction, thus achieving a short time necessary to form patch images as well as a short time necessary to detect the image density of each patch image. Accordingly, the time necessary to adjust the image formation condition can be shortened, which leads to improvement of productivity. The configuration of forming images at different contrast potentials by controlling the amount of light exposure can be applied to a configuration such that one patch image is formed between images whenever one sheet of image is formed as with the first embodiment (FIG. 10).

[Other Embodiment]

Wet-type image formation apparatus 100 shown in FIG. 1 includes one set of developing roller 5 and photoconductor 1. Wet-type image formation apparatus 100 may include a plural sets of developing rollers 5 and photoconductors 1 in order to form a color image. For example, the following configuration may be employed: four sets of them are prepared, toner images of respective colors of CMYK are respectively formed on four photoconductors 1, and then the respective toner images of the colors are put on one another on an intermediate transferring roller. For each of the colors of CMYK, the standard image formation condition setting flow and the image formation condition setting flow described in each of the above-described embodiments may be performed. Although degrees of change in densities differ among the colors, this configuration can provide an optimized image formation condition for each color. By performing image formation condition setting flow ST200 for each color of CMYK during image outputting, the image outputting does not need to be stopped even if the density of a color is varied, thereby improving productivity.

Wet-type image formation apparatus 100 shown in FIG. 1 does not include the so-called intermediate transferring roller, so that the toner image on photoconductor 1 is directly transferred onto recording medium M. Wet-type image formation apparatus 100 may employ a configuration such that the toner image on photoconductor 1 is primarily transferred onto the intermediate transferring roller and the toner image on the intermediate transferring roller is secondarily transferred onto recording medium M. Various recording media M can be widely employed.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A wet-type image formation apparatus comprising:

an image carrier carrying an electrostatic latent image;

a developer carrier conveying liquid developer to a developing portion, which is a position opposite to said image carrier, and developing said electrostatic latent image to form a toner image;

a detecting unit detecting an image density of said toner image; and a control unit adjusting, based on said image density detected by said detecting unit, conveyance amount and charge amount of toner in said liquid developer conveyed to said developing portion by said developer carrier, when setting a standard image formation condition for performing normal image formation, said control unit adjusting both said conveyance amount and said charge amount such that an image density of said toner image becomes constant even when a contrast potential is increased to be equal to or more than a predetermined standard contrast potential and such that a developing characteristic is obtained in which the image density of the toner image having become constant falls in a target density range, and setting a condition attained at a time of completion of the adjustments as said standard image formation condition, during the normal image formation, said control unit obtaining an image density of a patch image formed at a high contrast potential higher than said standard contrast potential and an image density of a patch image formed at a low contrast potential lower than said standard contrast potential, said control unit adjusting said conveyance amount when the image density of the patch image formed at said high contrast potential is varied from the developing characteristic for said standard image formation condition, said control unit adjusting said charge amount when the image density of the patch image formed at said low contrast potential is varied from the developing characteristic for said standard image formation condition.

2. The wet-type image formation apparatus according to claim 1, wherein during the normal image formation, the contrast potential is set at each of said standard contrast potential, said high contrast potential, and said low contrast potential, said detecting unit detects the image density of the patch image formed at said standard contrast potential, the image density of the patch image formed at said high contrast potential, and the image density of the patch image formed at said low contrast potential, and said control unit adjusts said conveyance amount or said charge amount based on three detection results for the image densities detected by said detecting unit.

3. The wet-type image formation apparatus according to claim 1, wherein during the normal image formation, the contrast potential is set at each of said high contrast potential and said low contrast potential, said detecting unit detects the image density of the patch image formed at said high contrast potential and the image density of the patch image formed at said low contrast potential, and said control unit adjusts said conveyance amount or said charge amount based on two detection results for the image densities detected by said detecting unit and a correction table provided in advance.

4. The wet-type image formation apparatus according to claim 3, wherein when setting said standard image formation condition for performing the normal image formation, said control unit sets said standard image formation condition and prepares said correction table.

5. The wet-type image formation apparatus according to claim 1, wherein said control unit adjusts said conveyance amount by changing rotating speed of a feeding roller supplying said liquid developer to said developer carrier, and adjusts said charge amount by changing an output of a charging device charging the toner in said liquid developer conveyed to said developing portion by said developer carrier.

6. A wet-type image formation apparatus comprising:

a developer carrier for forming a toner image on an image carrier;

a feeding device supplying liquid developer onto said developer carrier;

a charging device charging toner in said liquid developer;

a detecting unit detecting image densities of a plurality of patch images formed at different contrast potentials; and a control unit adjusting, based on the image densities of the plurality of patch images detected by said detecting unit, at least one of an amount of said liquid developer supplied to said developer carrier and a charge amount of the toner in said liquid developer, wherein the adjusting is based on whether the density of at least one patch image is formed at a contrast potential higher than a predetermined standard contrast potential or is formed at a contrast potential lower than the predetermined standard contrast potential.

7. The wet-type image formation apparatus according to claim 1, wherein said control unit:

obtains an image density of a patch image formed at said standard contrast potential, an image density of a patch image formed at the high contrast potential higher than said standard contrast potential, and an image density of a patch image formed at the low contrast potential lower than said standard contrast potential, adjusts said conveyance amount when the image density of the patch image formed at said high contrast potential is varied from the image density of the patch image formed at said standard contrast potential, and adjusts said charge amount when the image density of the patch image formed at said low contrast potential is varied from the image density of the patch image formed at said standard contrast potential.

* * * * *